United States Patent [19]

Pruett

[11] Patent Number: 4,835,523

[45] Date of Patent: May 30, 1989

[54] SKI BEEPER

[76] Inventor: Nicholas Pruett, 9752 NE. 124th Pl., P.O. Box 274, Kirkland, Wash. 98033

[21] Appl. No.: 90,086

[22] Filed: Aug. 24, 1987

[51] Int. Cl.[4] ..... G08B 13/14; A63C 11/00

[52] U.S. Cl. ..... 340/571; 280/809; 340/666

[58] Field of Search ..... 340/540, 571, 666; 280/809, 816

[56] References Cited

U.S. PATENT DOCUMENTS

| | | | |
|---|---|---|---|
| 4,279,433 | 7/1981 | Petaja | 340/571 X |
| 4,535,322 | 8/1985 | Yeski | 340/571 |
| 4,603,328 | 7/1986 | Larson | 340/666 |

*Primary Examiner*—Glen R. Swann, III
*Assistant Examiner*—Thomas J. Mullen, Jr.
*Attorney, Agent, or Firm*—Russell W. Illich

[57] ABSTRACT

A ski beeper which is an electronic device to assist a skier in locating skis buried beneath snow as a result of becoming detached from ski boots. The ski beeper is mounted to the ski in a position where the ski boot depresses an activator button on the device. In the event the ski boot releases from the binding and ski, the spring loaded activator button raises and in turn causes the beeper to become activated thus alerting the skier of the position of the ski. Alternatively, the ski beeper may be integrated into the heel plate of a ski brake with the beeper device becoming activated as the ski brake lifts away from the ski.

3 Claims, 2 Drawing Sheets

SKI BEEPER

BACKGROUND OF THE INVENTION

Within the skiing industry, the fairly recent development of the ski brake has solved many of the long existing problems associated with safety straps which attached the boot to the ski or binding. These problems included the inconvenience of using safety straps, injuries caused by skis still tethered to the boot but released from the binding, and runaway skis caused by broken safety straps.

However, a new problem has arisen with the use of ski brakes. Namely, when the boot is released from the binding as a result of a fall; oftentimes, the ski becomes buried beneath the snow becoming very difficult to find after the fall. Hence, with the ski industry using the ski brake almost exclusively as a safety means, there is a pressing need to come up with a solution for lost skis resulting from the use of ski brakes.

The present invention solves this problem through a device which may be adapted to any type of ski, binding, and/or ski brake.

SUMMARY OF THE INVENTION

The present invention comprises an electronic device which includes a beeper which is activated upon the release of a ski boot from a binding. The beeper alerts the skier as to the position of the ski.

An object of this invention is to provide an impact resistant device which is also waterproof to withstand the conditions associated with skiing.

Another object of this invention is to provide a ski beeper device which may be adapted to mount to a ski or ski brake, or alternatively, integrated directly into a ski part such as a ski, ski brake, or binding.

It is yet another object to provide a device which is economical to use and easy to adapt and mount to a ski part.

Further objects and advantages of the invention will become apparent from the drawings, detailed description, and appended claims as follows.

DETAILED DESCRIPTION OF THE INVENTION

Figure 1:
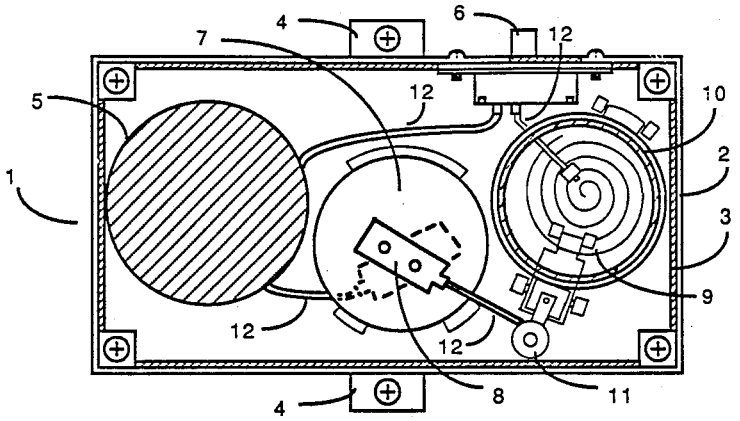
FIG. 1 is a sectional view of the ski beeper device.
Figure 2:
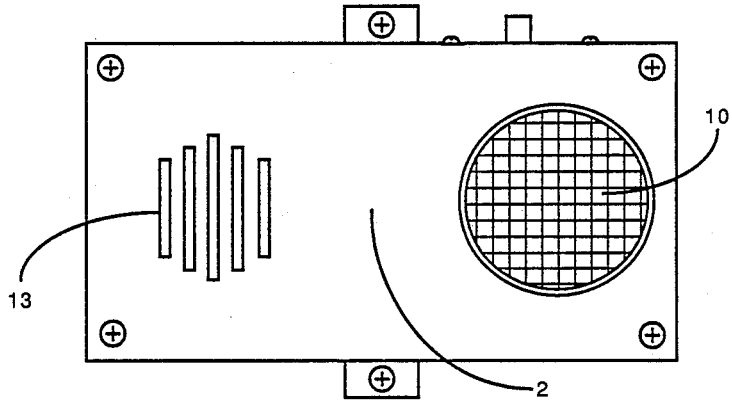
FIG. 2 is a plan view of the device along a plane parallel to the sectional view shown in FIG. 1.

FIG. 1 depicts the internal parts of the ski beeper device 1. The major components of the device 1 include a top casing 2 covering a base plate 3. The casing includes mounting flanges 4 extending outwardly from the sides of the casing. The casing and base are made of an impact resistant material such as a hard plastic or metal to protect the internal components. Mounted within the casing is a beeper 5, an on-off switch 6, and batteries 7. Also shown are a pair of connecting plates above and below the batteries for providing current to the circuit. A coiled compression spring 9 serves two functions. First, it biases the activator button 10 outwardly from the surface of the casing as best seen in FIG. 2. Second, it contacts a contact plate 11 for completing the circuit when the activator button is released and biased outwardly. Connecting wires 12 connect the various components described to finish the electronic circuit. FIG. 2 further shows slots 13 within the top of casing 2 to provide a means for a beeping signal to be released from the device.

Figure 3:
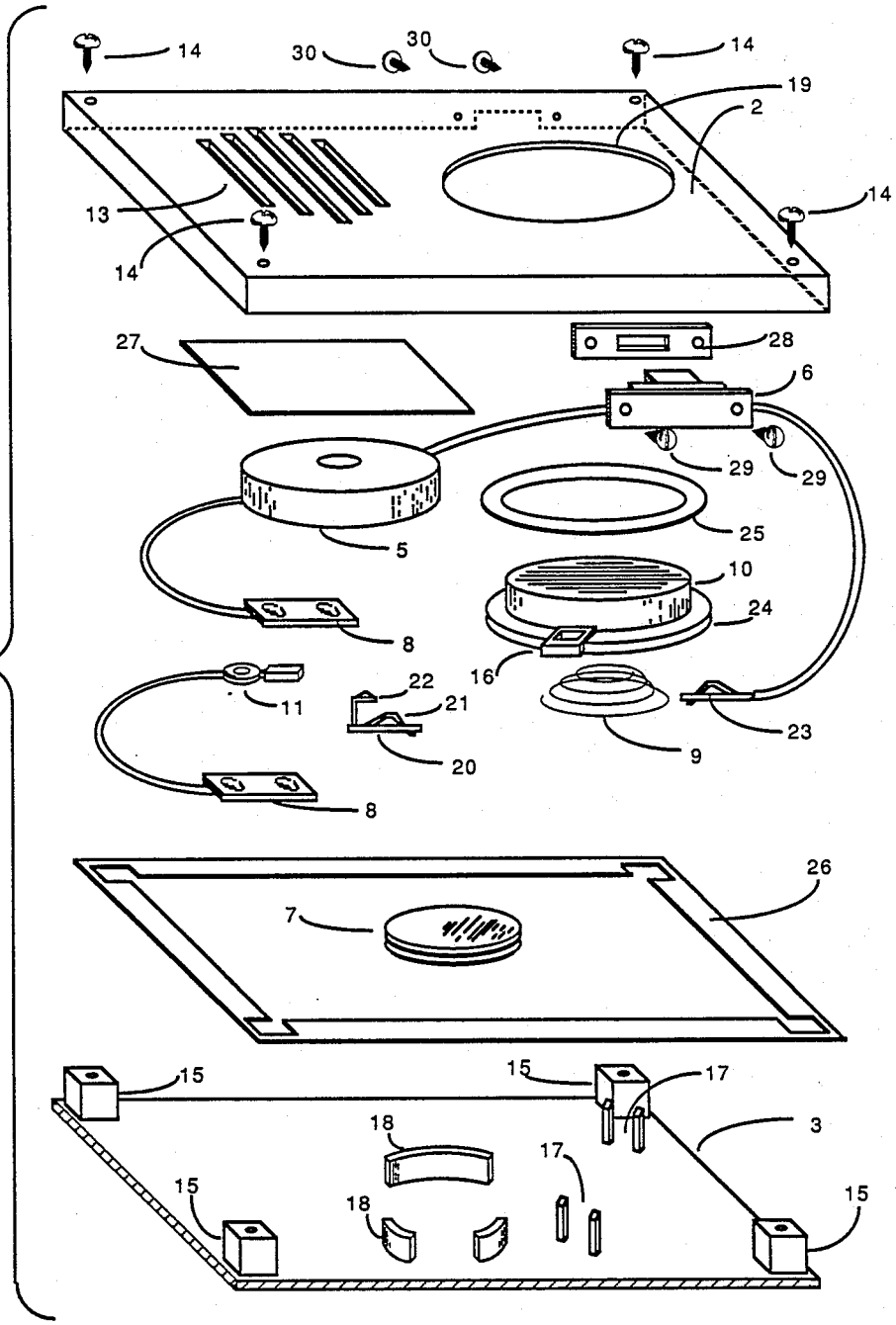
FIG. 3 is an exploded perspective view of the ski beeper device and its associated parts.

Turning to the exploded view as shown in FIG. 3 it can be seen that casing 2 is attached to the base 3 through mounting screws 14 which thread into screw mounts 15 which extend upwardly from the base. The activator button 10 includes outwardly extending flanges 16 (only one shown) which guide the button through button control supports 17 on the base. Also extending upwardly from the base are battery supports 18 which hold the batteries 7 in place.

The activator button 10 is hollow to house spring 9 which biases the button outwardly from the casing through aperture 19. The flange 16 shown connects the button to the contact plate 11. A clamp 20 is attached to the spring 9 through a lower leg 21. The contact 11 presses upwardly against an upper leg 22 of the clamp completing the circuit when the activator button is free to move upwardly. Connecting plates 8 connect the batteries to the contact 11 and beeper 5, respectively. Another clamp 23 connects the spring to the on-off switch 6. The activator button further includes an outer encircling flange 24 to support a waterproof gasket ring 25. Three additional water proof gaskets 26, 27, and 28 are provided to seal the base, cover the slots 13 of the casing, and seal the on-off switch 6, respectively. Gasket 28 is further provided with holes through which screws 29 attach the switch 6 and through which the switch assembly is attached to the side of the casing through screws 30.

In operation, the ski beeper device is mounted to a specific part of the ski. When a skier steps into the binding, the activator button 10 is depressed. At this time, the skier reaches down and flips the switch 6 to the "on" position. With the activator button in the depressed condition, the contact plate 11 is out of contact with the clamp 20 leaving the circuit open while the skier remains on the ski. In the event of a fall, the skier becomes disconnected from the ski through release of the binding. With no pressure on the button 10 any longer, the spring 9 biases the button outwardly which moves contact plate 11 into contact with clamp 20, thus closing the circuit. At this time the beeper 5 sounds through slots 13 enabling the skier to locate the ski if it is buried beneath snow or lost in some woods, bushes or other debris. The water resistant seals 25–28 prevent snow from accumulating within the device and affecting the parts.

Figure 4:
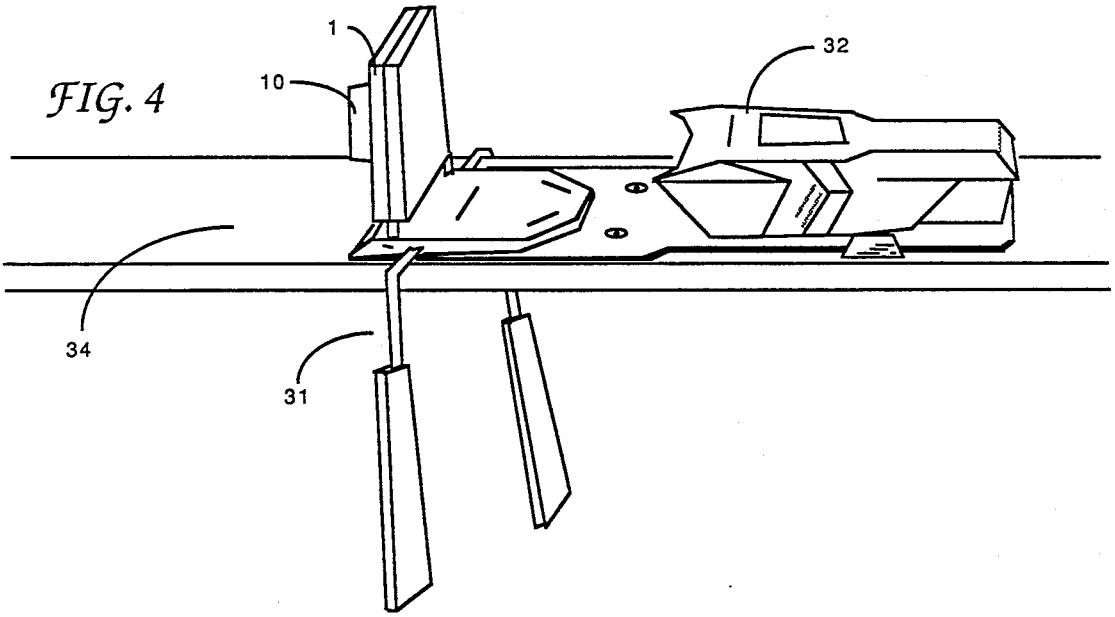
FIG. 4 is a perspective view of the device attached directly to a ski brake.

A specific application of the device is shown in FIG. 4 where the ski beeper device 1 is integrated into a ski brake 31. As a ski boot (not shown) steps into binding 32 the boot depresses the heel plate 33 of the ski brake. As the heel plate moves down the activator button 10 of the ski beeper device 1 is pressed against the ski 34. Operationally, the device works as described above in the event the ski boot is released from the binding. The ski brake rotates upwardly to the position shown in FIG. 4, thus activating the ski beeper device.

The above description is only a preferred embodiment of the invention. Many different applications and modifications may be made to the ski beeper device which are still encompassed by the spirit of the invention. For example, the ski beeper may be mounted in a variety of ways on the ski. Also the internal electronic parts may be replaced with equivalent parts or a silicon microchip.

It is to be understood that the above description is not limiting to the spirit of invention, and that the scope of the invention is set forth within the following claims.

What is claimed is:

1. A ski location device comprising:

rigid housing means for mounting to a ski part, said housing comprising an enclosed shell with a mounting base and a top surface, an aperture along said top surface of said shell, means for mounting the shell to the ski part, and waterproof means to prevent moisture from entering the housing between said shell and ski part, an alarm means mounted within the housing for sounding an alarm in response to a ski boot releasing from the ski part, a first switch means for activating said alarm means when the ski boot becomes released from the ski part, said first switch means comprising a movable plunger with a first part extending outwardly from said aperture of said housing, said plunger including a second part remaining encased by said shell and having a first contact mounted on said second part and waterproof means between the plunger and housing to prevent moisture from entering said housing through said aperture, said first switch means further comprising a second contact rigidly mounted within the housing, a power source for providing electrical current to the alarm means for activating the alarm means, said power source including at least one removable battery cell rigidly mounted to said mounting base, a circuit means for connecting said power source to said alarm means and said first switch means, said circuit means including a second switch means for disconnecting the power source from said alarm means, wherein, in a first position the ski boot compresses the first part of said plunger and holds the first contact of said first switch means away from the second contact and in a second position the ski boot is released from the ski part whereby the first part of said plunger moves outwardly from said housing causing said first contact to engage said second contact and complete the circuit means thereby activating the alarm means.

2. A ski location device as claimed in claim 1, wherein said movable plunger is spring biased outwardly from said housing by a coil spring, said coil spring having a first position where it is compressed when the ski boot is compressing the first part of said plunger and a second position where the coil spring biases the plunger outwardly when the ski boot is released from the binding.

3. A ski location device as claimed in claim 1, wherein said second switch means comprises a manually movable switch mounted on said housing and is movable between two positions, a first position wherein the alarm means and power source are connected via said circuit means to allow for the alarm means to become activated in response to said first switch means and a second position wherein said alarm means is disconnected from said power source.

* * * * *